US008333628B2

(12) United States Patent
Shiomi et al.

(10) Patent No.: US 8,333,628 B2
(45) Date of Patent: Dec. 18, 2012

(54) OUTBOARD ENGINE

(75) Inventors: Kazuyuki Shiomi, Wako (JP); Tetsuro Ikeno, Wako (JP); Takeshi Okada, Wako (JP); Masayuki Osumi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 390 days.

(21) Appl. No.: 12/064,569

(22) PCT Filed: Aug. 18, 2006

(86) PCT No.: PCT/JP2006/316663

§ 371 (c)(1),
(2), (4) Date: Feb. 22, 2008

(87) PCT Pub. No.: WO2007/023927

PCT Pub. Date: Mar. 1, 2007

(65) Prior Publication Data

US 2009/0104826 A1 Apr. 23, 2009

(30) Foreign Application Priority Data

Aug. 22, 2005 (JP) ..... 2005-240081
Jun. 30, 2006 (JP) ..... 2006-181162

(51) Int. Cl.
*B63H 20/32* (2006.01)
*B63H 20/00* (2006.01)
*B63H 20/08* (2006.01)
*B63H 20/34* (2006.01)

(52) U.S. Cl. ..... 440/76; 440/78

(58) Field of Classification Search ..... 440/76–78
See application file for complete search history.

(56) References Cited

U.S. PATENT DOCUMENTS

| | | | | |
|---|---|---|---|---|
| 2,764,119 | A | 9/1956 | Sigler | |
| 2,860,594 | A * | 11/1958 | Kiekhaefer | 440/66 |
| 3,153,397 | A * | 10/1964 | Mattson et al. | 440/76 |
| 3,408,975 | A * | 11/1968 | Gamble | 440/40 |
| 4,995,840 | A | 2/1991 | Seale et al. | |
| 5,005,506 | A * | 4/1991 | Handmer | 114/55.53 |
| 5,370,564 | A | 12/1994 | Fujimoto et al. | |
| 6,875,066 | B2 * | 4/2005 | Wolaver | 440/77 |
| 7,322,866 | B2 * | 1/2008 | Shiomi et al. | 440/76 |
| 7,485,019 | B1 * | 2/2009 | Macier et al. | 440/76 |
| 8,206,192 | B2 * | 6/2012 | Shiomi et al. | 440/76 |

(Continued)

FOREIGN PATENT DOCUMENTS

CA 2219750 A * 4/1999

(Continued)

OTHER PUBLICATIONS

International Search Report of PCT/JP2006/316663, date of mailing Nov. 27, 2006.

(Continued)

*Primary Examiner* — Ajay Vasudeva
(74) *Attorney, Agent, or Firm* — Westerman, Hattori, Daniels & Adrian, LLP

(57) ABSTRACT

An outboard engine includes a buoyant member (20). The buoyant member has concavities (20L, 20R; 120L, 120R) formed in at least one side thereof. A plurality of outboard engines is mounted in parallel on the stem, and the concavities prevent interference with the other adjacent outboard engines when any of the outboard engines are tilted up.

1 Claim, 12 Drawing Sheets

U.S. PATENT DOCUMENTS

2005/0042437 A1* 2/2005 Ramesh et al. ..... 428/304.4

FOREIGN PATENT DOCUMENTS

| | | | | |
|---|---|---|---|---|
| DE | 1291249 | B | | 3/1969 |
| DE | 1756174 | A1 | | 9/1970 |
| JP | 47-9194 | U | | 10/1972 |
| JP | 62139781 | A | * | 6/1987 |
| JP | 05270489 | A | * | 10/1993 |
| JP | 05278673 | A | * | 10/1993 |
| JP | 5-319386 | A | | 12/1993 |

OTHER PUBLICATIONS

English Translation of Chinese Office Action dated May 22, 2009, issued in corresponding Chinese Patent Application No. 2006-80030548.4.

* cited by examiner

OUTBOARD ENGINE

TECHNICAL FIELD

The present invention relates to an outboard engine mounted on the stern of a boat and, more particularly, to an outboard engine having a buoyant member for lifting the outboard engine upward to allow the boat to start moving smoothly from a standstill state.

BACKGROUND ART

In a boat that moves by the use of an outboard engine, when the boat is at a standstill and when the boat begins to move, the level of the stern of the boat drops and sinks into the water, and the bow rises and is tilted upward. Since the hull therefore begins to move in a tilted state, the water resistance is considerable when traveling starts and adequate boat speed cannot be obtained. The stern must rise upward a certain amount and the orientation of the boat must become approximately horizontal in order to reach a certain level of speed. There is a problem in that time is required for the boat to approximate an orientation that is nearly horizontal, and the boat cannot smoothly accelerate.

An outboard engine that can improve the acceleration characteristics of a boat is disclosed in Japanese Patent Laid-Open Publication No. 5-319386 (JP-5-319386A) and Japanese Utility Model Laid-Open Publication No. 47-9194 (JP-UM-47-9194A).

In the outboard engine of the 5-319386A publication, an engine, a vertically disposed drive shaft and other drive components, and transmission components are covered by a vertical cowling. A propulsion casing is disposed below the lower cowling so as to provide vertical linkage. When the boat is at a standstill, a portion of the lower cowling is submerged, and when the boat is moving, only the propulsion casing is submerged.

In the outboard engine of the 47-9194A publication, the waterproof engine casing that covers the engine is formed having a size that is sufficient to provide flotation to the engine, and the engine is designed to float on the surface of the water.

In the outboard engine of the 5-319386A publication, however, a portion of the lower cowling that forms the engine room is structured to submerge and it is therefore difficult to endow this structure with water tightness when the lower cowling is assembled. When water has furthermore flooded the engine room, it is difficult to drain the water, the movement of movable components is compromised by water and salt, and the components tend to corrode.

Thus, when a buoyant member that has volume is provided to the outboard engine main body in an outboard engine mounted on the stern, the buoyant member is mounted on a bottom case positioned below the engine room, and an extension case positioned below the bottom case. The width of the outboard engine is accordingly increased from the middle portion in the vertical direction of the outboard engine to the bottom portion of the engine. When such wide outboard engines are mounted in parallel on the stern, there is a danger of the adjacent buoyant members of the outboard engines creating interference when any of the outboard engines is tilted up or turned for steering in order to perform maintenance or storage.

In view of the above, it is necessary to provide an engine in which the extension casing and other watertight structures are not affected, the extent to which the stern of a boat is submerged during stopping or acceleration can be reduced, and the hull orientation can be rapidly brought to a near-horizontal state during acceleration; and in which the buoyant member of an adjacent outboard engine is prevented from creating interference during tilting or the like when a plurality of outboard engines is mounted in parallel on the stern.

DISCLOSURE OF THE INVENTION

According to a first aspect of the present invention, there is provided an outboard engine comprising a power source, a power source room for accommodating the power source, and a buoyant member that is disposed outside of the power source room and is provided with concavities formed in at least one side part thereof.

Thus, since the outboard engine is provided with a buoyant member, the depth of the stern when the boat is at a standstill or moving at low speed is reduced, and the tilting of the hull is corrected so as to be nearly horizontal. The time required for exceeding a threshold, i.e., for overcoming bow waves, during acceleration can therefore be shortened and smooth acceleration can be achieved. After acceleration, the buoyant member rises above the waterline, and therefore does not form a resistance in the water during travel, and high speed maneuverability is not compromised.

Moreover, since concavities are formed in the sides of the buoyant member in the outboard engine described above, interference with another outboard engine can be avoided when the outboard engines are turned for steering and particularly when the outboard engines are tilted up during maintenance work and storage, even when two or more outboard engines provided with buoyant members are mounted in parallel on the stern. Therefore, the outboard engines can be freely mounted without leaving a mutual installation gap larger than necessary. The present invention is therefore useful when using outboard engines in which a plurality of buoyant members is mounted on the stern of the outboard engines.

The above-described buoyant members are preferably asymmetrical on the left and right. The buoyant members are therefore simplified, and the outboard engines do not interfere with each other when two outboard engines are mounted on the stern.

The above described buoyant members are preferably constructed of transversely divided left and right buoyant member halves. Therefore, the structure of the buoyant members is simplified when the transversely halved buoyant members are joined to obtain a single buoyant member. The necessary number of components can be produced by using separate left and right parts, yields can be improved, and custom installation by a user is made possible.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

The outboard engine of a first embodiment is described below with reference to FIGS. 1 to 6.

Figure 1:
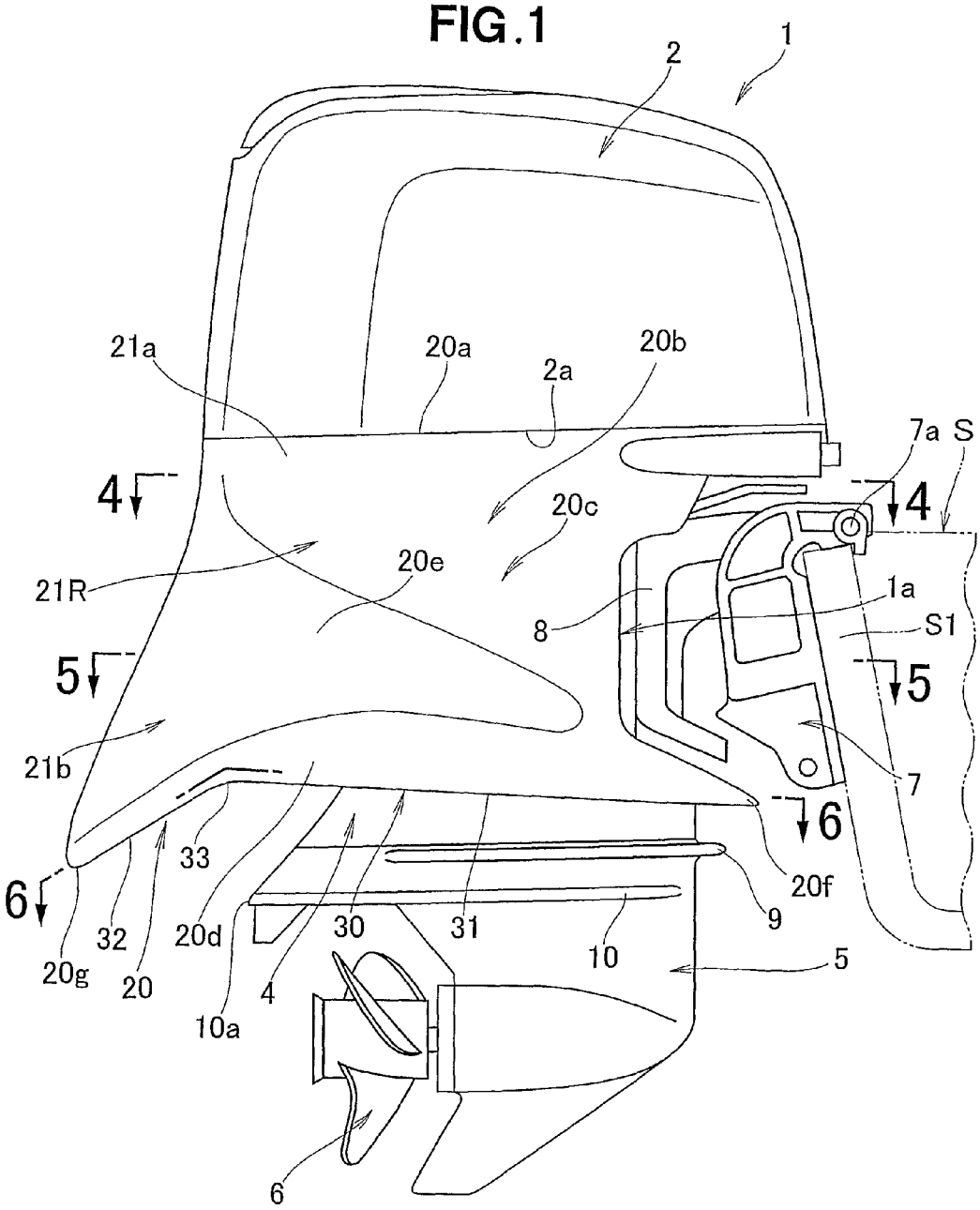
FIG. 1 is a side view of an outboard engine according to a first embodiment of the present invention.
Figure 2:
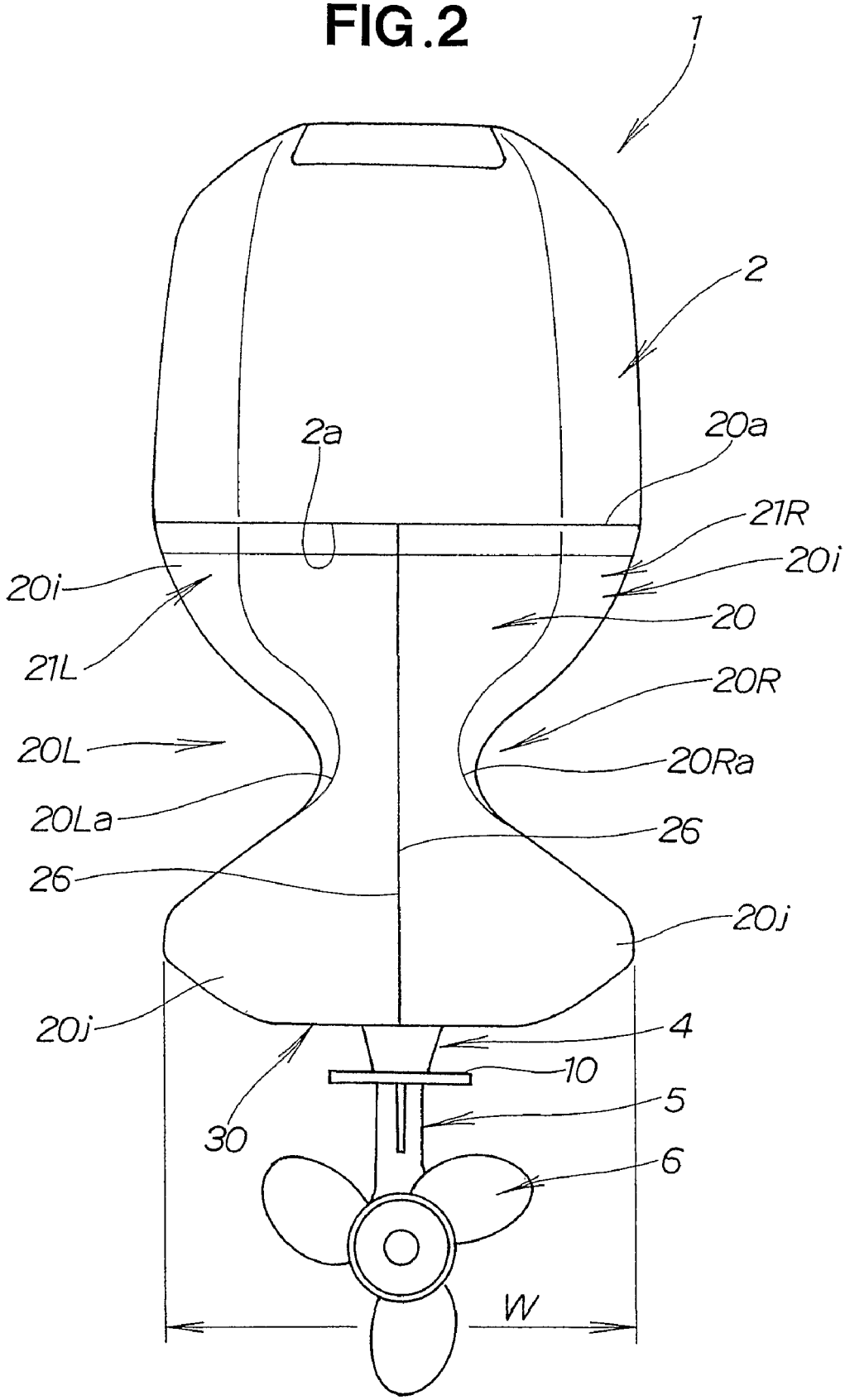
FIG. 2 is a rear view of the outboard engine shown in FIG. 1.
Figure 3:
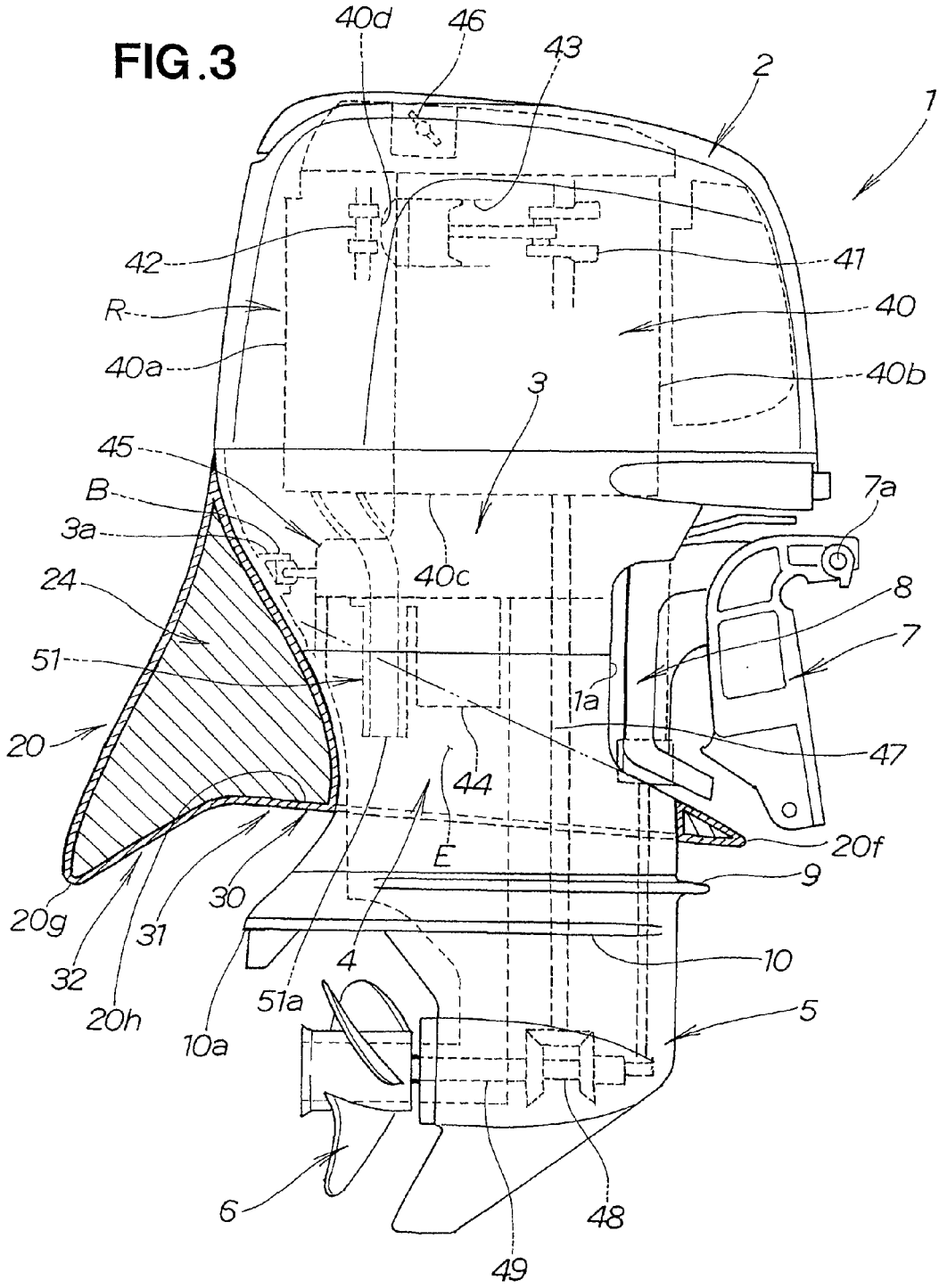
FIG. 3 is a cross-sectional view of the outboard engine shown in FIG. 1.

The outboard engine 1 has an engine cover (top cover) 2 that covers the upper half of an engine (power source) 40, and an undercover 3 that covers the lower half of the engine 40, as shown in FIGS. 1, 2, and 3. An engine room R is formed by the engine cover 2 and undercover 3. An extension case (leg body) 4, which is a drive shaft case, is disposed below the undercover 3. A gear case 5 having a propeller 6 for propulsion is disposed below the extension case 4.

A concavity 1*a* that is concave in the rearward direction of the outboard engine 1 is formed on the front portion of the extension case 4. The outboard engine 1 is mounted on the stern S1 of a hull S by way of a stern bracket 7. The stern bracket 7 is mounted on the concavity 1*a*. A swivel case 8 rotatably supports the outboard engine 1 in the horizontal direction. The outboard engine 1 furthermore swings vertically about a tilt shaft 7*a* mounted on the stern bracket 7.

An anti-splash plate 9 is formed on the upper external peripheral portion of the gear case 5. An anti-cavitation plate 10 extending so as to protrude from behind the propeller 6 is formed on the external periphery of the gear case 5 below the anti-splash plate 9.

The engine 40 is a vertical engine in which a crank shaft 41 and a cam shaft 42 are vertical, as shown in FIG. 3. The engine 40 is accommodated in an engine room R formed by the engine cover 2. The engine 40 is a multi-cylinder four-stroke engine in which a plurality of horizontally disposed cylinders 30 is arrayed in the vertical direction.

The engine 40 has an engine head 40*a* disposed in the rearward position of the outboard engine 1 and an engine main body 40*b* positioned in the longitudinally intermediate portion of the outboard engine 1. The engine head 40*a* includes a cylinder head and a head cover. The engine main body 40*b* includes a cylinder block and a crank case. The undercover 3 covers a bottom portion 40*c*, which is the lower portion of the engine 2. A mounting case 45 is disposed inside the undercover 3 and houses an oil pan 44.

A throttle valve 46 is part of an air intake device.

A drive shaft 47 passes vertically through the interior of the mounting case 45, extension case 4, and gear case 5. The drive shaft 47 rotatably drives the propeller 6 by way of a gear mechanism 48 and an output shaft 49 inside the gear case 5.

A combustion chamber 40*d* is formed by the engine head 40*a* and engine main body 40*b*. An exhaust channel 51 is in communication with the exhaust port of the combustion chamber 40*d*. An exhaust port 51*a* of the exhaust channel 51 extends to the vicinity of the vertically intermediate portion inside the extension case 4. The interior of the extension case 4 is an expansion chamber E.

A buoyant member 20 for preventing the stern S1 shown in FIG. 1 from dipping into the water when the boat is at a standstill and when the hull S is accelerating is mounted from the upper portion of the undercover 3 to the lower portion of the extension case 4 of the outboard engine 1 so as to encompass the external periphery of these components. The buoyant member 20 is mounted separately from the undercover 3. The front end portion 20*f* of the buoyant member 20 is positioned so as to protrude forward from the front end of the extension case 4, and the rear end portion 20*g* is positioned so as to protrude rearward beyond the propeller 6 and the rear end 10*a* of the anti-cavitation plate 10.

The buoyant member 20 has left and right buoyant member halves 21L and 21R divided on the left and right, as shown in FIG. 2. The right and left buoyant member halves 21L and 21R are mounted on the undercover 3 and extension case 4 by being joined together.

The lowest position B (referred to in the description below as "bottom") of the engine room R is formed by the undercover 3 and mounting case 45, as shown in FIG. 3. The buoyant member 20 has a lower surface wall 20*h* positioned further below the undercover 3, and has a closed space. The closed space has a voluminous portion that displaces water and imparts buoyancy to the outboard engine 1.

The structure of the buoyant member 20 is described next with reference to FIGS. 4, 5, and 6. The left and right buoyant member halves 21L and 21R have left and right symmetrical shapes.

Figure 4:
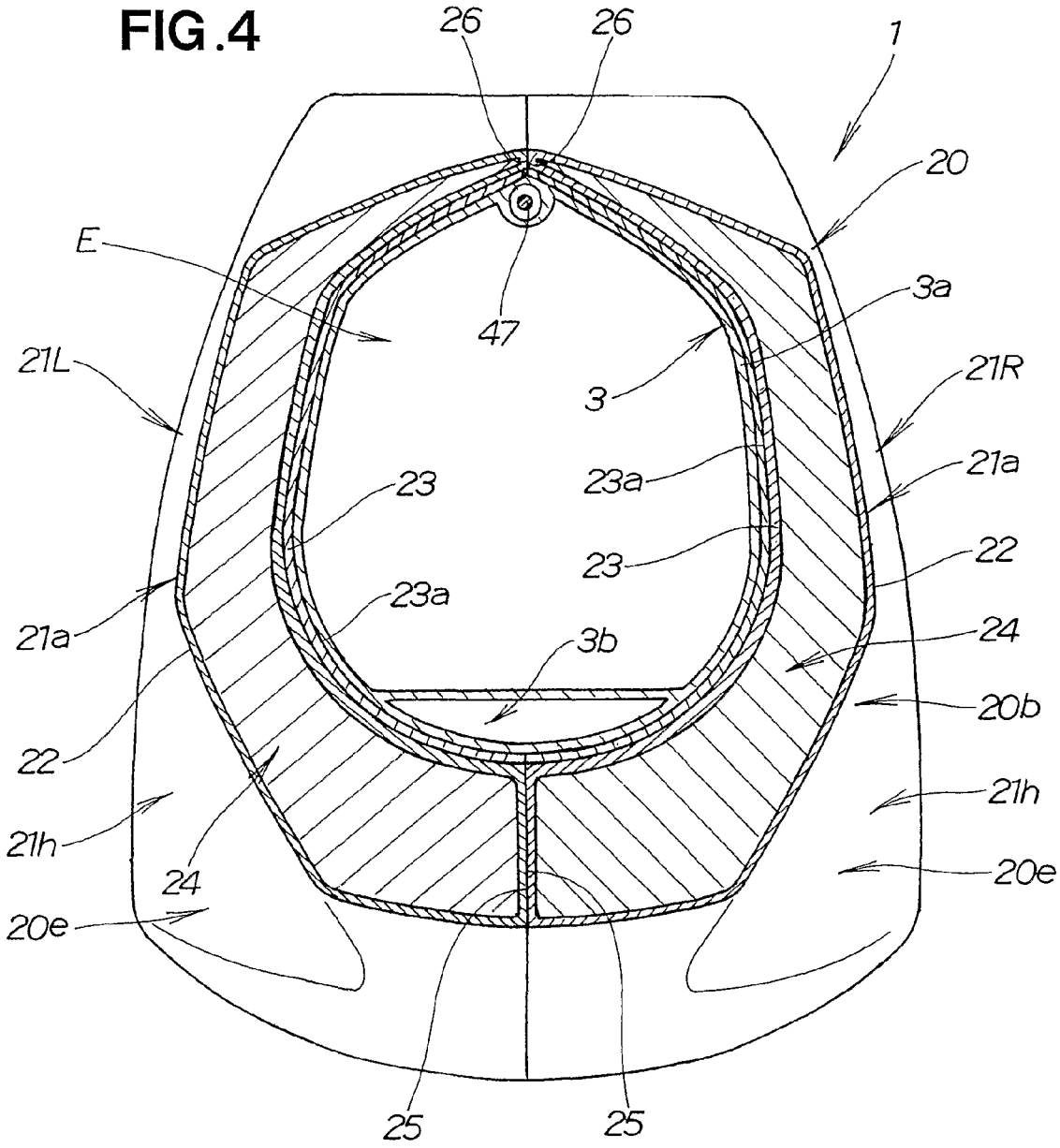
FIG. 4 is a cross-sectional view taken along line 4-4 of FIG. 1.

FIG. 4 shows a cross-section of the upper portion of the buoyant member 20. The longitudinal dimension of the upper portions 21*a* and 21*a* of the left and right buoyant member halves 21L and 21R is less than the longitudinal dimension of the intermediate and lower portions in the vertical direction shown in FIGS. 5 and 6.

The upper portions 21*a*, 21*a* of the buoyant member halves 21L, 21R have a curved shape in which the longitudinally central portions expand outward. The buoyant member halves 21L and 21R have an external wall 22 and an internal wall 23, and the walls 22 and 23 form a closed space. A buoyancy-imparting filler material 24, e.g., styrene foam, fills the closed space. A foam material that is composed of various resins, is lightweight, and has a lower specific gravity than water can be used as the foam material 24. The walls 22 and 23 may be continuously formed with the same member as the foam material 24. In this case, the extent of foaming of the foam inside the foam material 24 may be increased and made greater than the extent of foaming in the area of the inner wall and/or the vicinity of outer wall.

The inner surfaces 23*a* and 23*a* of the internal walls 23 and 23 are in close contact along the outer surface 3*a* of the undercover 3. The upper portion of the extension case 4 is positioned inside the undercover 3. The left and right buoyant member halves 21L and 21R have front and rear butted joint surfaces 25, 25, 26, and 26. The rear joint surfaces 25 are longer than the front joint surfaces 26 in the front/rear direction.

The width of the longitudinally intermediate portion in the upper portion 20*b* of the buoyant member 20 is greater than the width of the front and rear portions, and the intermediate portion has a shape that expands outward to the two sides.

Figure 5:
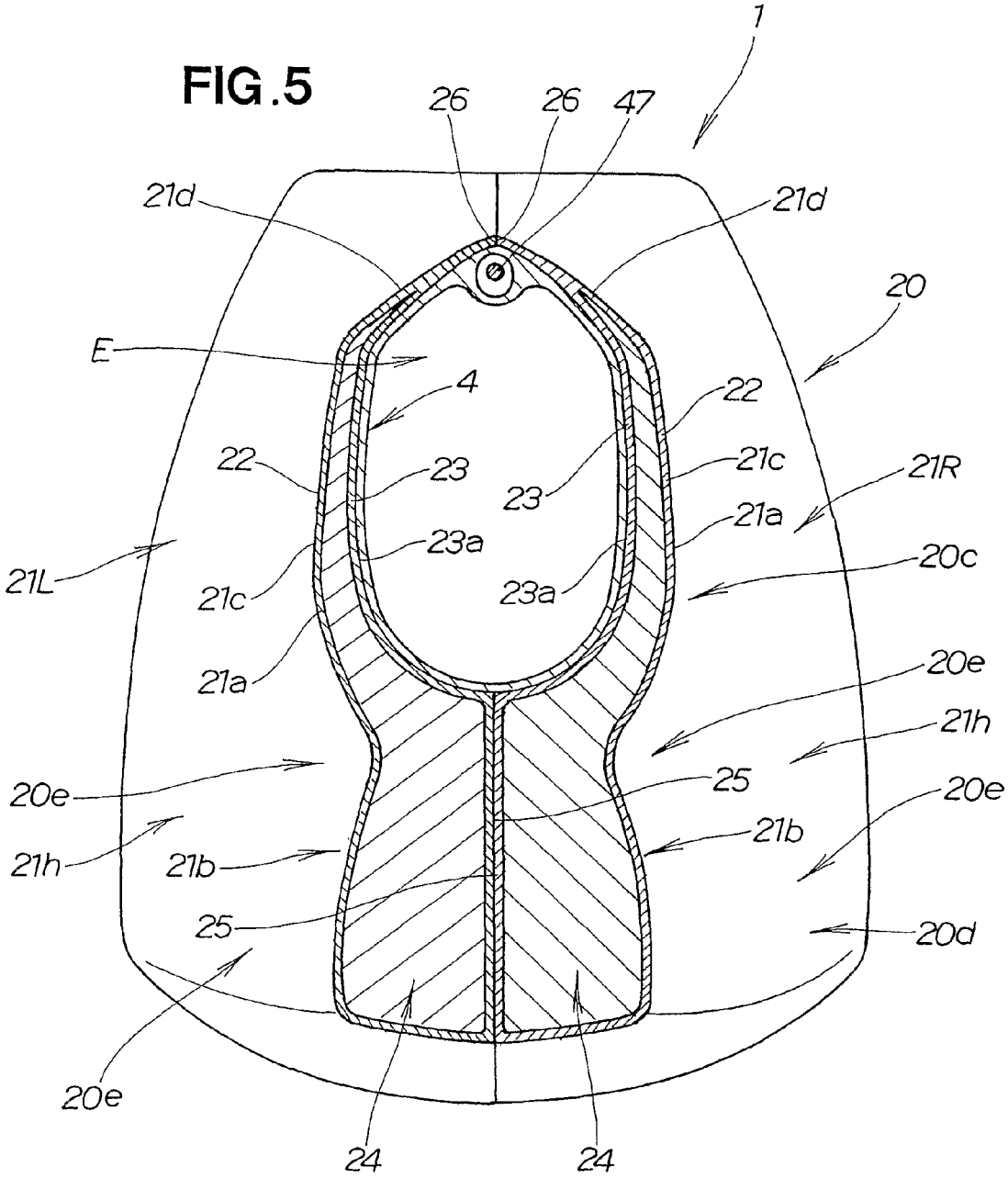
FIG. 5 is a cross-sectional view taken along line 5-5 of FIG. 1.

FIG. 5 shows a cross-section of the intermediate portion, of the buoyant member 20 and extension case 4.

The rear portions 21*b* and 21*b* of the left and right buoyant member halves 21L and 21R in the vertically intermediate portion 20*c* of the buoyant member 20 have longitudinally extended joint surfaces 25 and 25 and are joined at the joint surfaces 25 and 25. The outer surface of the extension case 4 is in close contact with the inner surfaces 23*a* and 23*a* of the internal walls 23 and 23 of the left and right buoyant member halves 21L and 21R in the vertically intermediate portion 20*c* of the buoyant member 20.

The width gradually narrows from the intermediate portions 21*c* and 21*c* of the buoyant member halves 21L and 21R to the front portions 21*d* and 21*d*, and the left and right buoyant member halves 21L and 21R merge in the area of the front end joint surfaces (joint edges) 26 and 26. The front portions 21*d*, 21*d* of the buoyant member halves 21L, 21R extend along the shape of the extension case 4 and allow the outboard engine 1 to adequately turn for steering.

Figure 6:
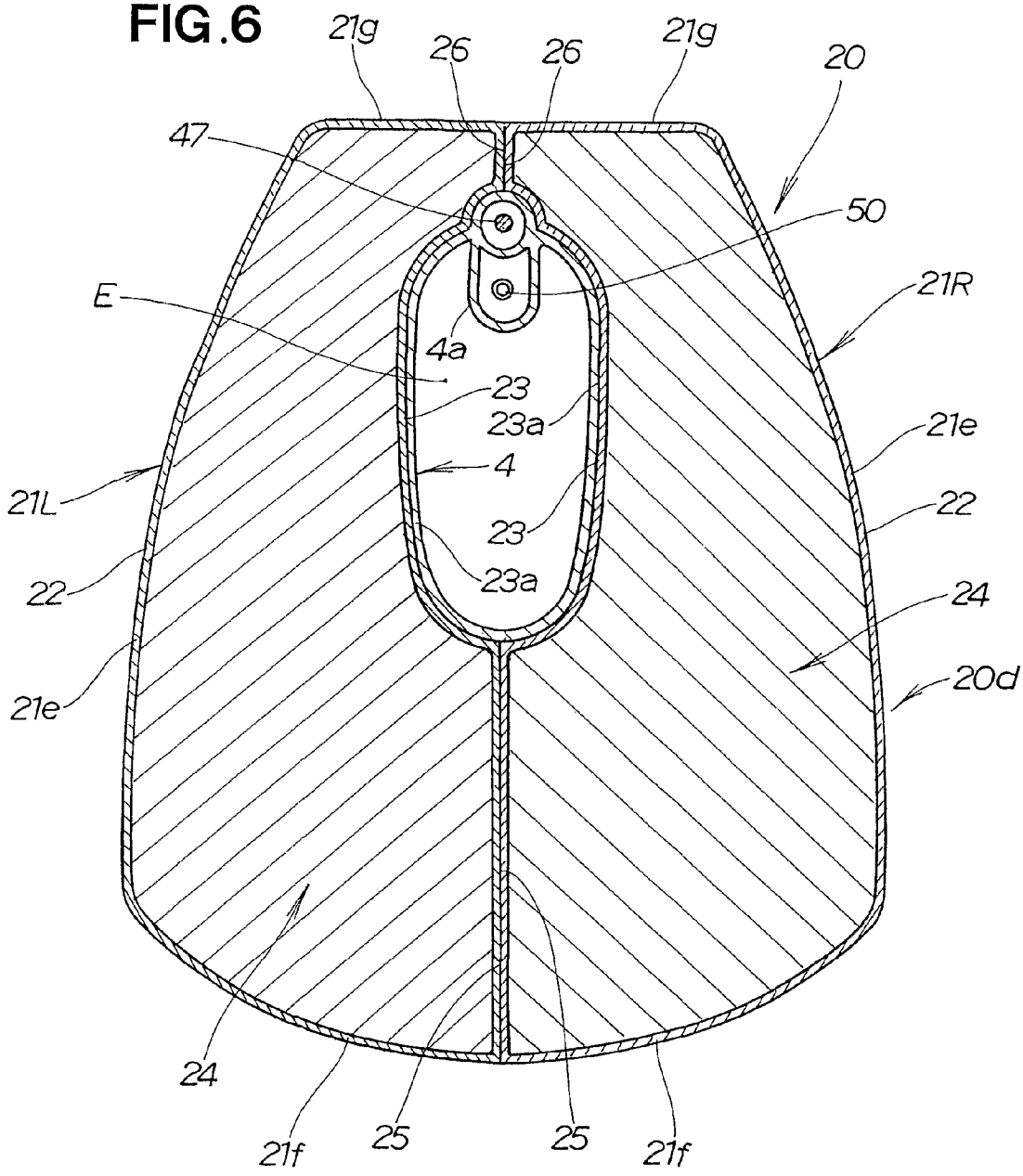
FIG. 6 is a cross-sectional view taken along line 6-6 of FIG. 1.

FIG. 6 shows a cross section of the lower portion area of the buoyant member 20.

The two external side surfaces 21*e* and 21*e* of the left and right buoyant member halves 21L and 21R extend slightly outward in the lower portion 20*d* of the buoyant member 20. The rear surfaces 21*f* and 21*f* are curved so that the joint surfaces 25 and 25 extend rearward in a joined state. The front surfaces 21*g* and 21*g* are flat when the joint surfaces 26 and 26 are joined.

A sub-expansion chamber 3*b* for idling is in communication with the outside air port (not shown), as shown in FIG. 4.

The drive shaft 47 is connected to the crankshaft 41 of the engine 40, as shown in FIGS. 3 to 6, and is vertically disposed so as to drive the propeller 6.

A water feed tube 50 for cooling the engine vertically passes through the interior of a partitioned dividing wall 4*a*, as shown in FIG. 6.

The rear portions of both side surfaces of the buoyant member 20 have an hourglass shape and have long and thin v-shaped concavities 21*h* formed so as to gradually decrease in width toward the front, as shown in FIG. 1. The concavities 21*h* are symmetrically formed in the left and right buoyant member halves 21L, 21R.

The lower portion 20*d* of the buoyant member 20 shown in FIG. 6 is wider than the upper portion 20*b* and intermediate portion 20*c*, and the amount of protrusion is greatest in the rearward direction and is least in the forward direction.

The shape of a lower surface 30 of the buoyant member 20 will next be described based on FIGS. 1 and 3.

The lower surface 30 of the buoyant member 20 has a front half portion 31 that slopes downward at a somewhat gradual angle from the longitudinally intermediate portion toward the front portion, as shown in FIG. 1.

The lower surface 30 has a rear portion 32 that slopes rearward and downward from a bend portion 33 in the highest position of the front half portion 31. The lower surface 30 of the buoyant member 20 is curved in the form of a dogleg as viewed from the side. The buoyant member 20 can be formed in a low position on the outboard engine 1 by using the lower surface wall 20*h* (FIG. 3) that forms the lower surface 30, and the bottom B of the engine room R can be kept in a high position on the outboard engine 1.

The buoyant member 20 is externally mounted, rather than being mounted in the engine room R formed by the engine cover 2, as shown in FIG. 3. The depth of the outboard engine 1 in the water when the boat is at a standstill is reduced by the buoyancy of the buoyant member 20. The depth of the stern in the water is reduced by the buoyancy of the buoyant member 20 particularly when the boat is moving at low speed, and the tilt of the hull is corrected so as to be nearly horizontal.

In this manner, when the hull S has accelerated from low speed travel, the buoyancy of the buoyant member 20 provides resistance against further sinking during acceleration, the time required to exceed the threshold, i.e., to overcome bow waves, is shortened by reducing the tilt, and smooth acceleration can be achieved. After acceleration, most of the buoyant member 20 appears above the waterline, water resistance is therefore not produced during travel, and high speed maneuverability is not compromised.

The buoyant member 20 is formed by the lower surface wall 20*h* of buoyant member 20 apart from the bottom B of the engine room R formed by the upper half of the undercover 3. Therefore, the engine room R does not need to be lowered below the waterline, the engine room is not liable to flood, and an area for draining water from the engine room R can be disposed above the waterline.

The rear portion 32 of the lower surface 30 of the buoyant member 20 is thus sloped. The rear portion therefore is subject to water resistance when the hull S is propelled, and buoyant force that lifts up the stern S1 is generated by the pressure difference between the upper and lower surfaces of the rear portion sloped surface 32.

The outboard engine 1 is naturally endowed with static buoyancy because of the buoyant member 20, and the lower surface 30 of the buoyant member 20 has an angle of attack with respect to the straight surface of the front half 31 due to the sloped surface of the rear portion 32.

Therefore, in addition to the buoyant force of the buoyant member 20 itself, an upward lifting force produced from below by the pressure of water, i.e., a dynamic buoyancy operates and an effective lifting force is provided. The hull can achieve smooth, horizontal travel by the buoyancy provided by this lifting force and the buoyant member 20.

When a plurality of the outboard engines 1 shown in FIG. 1 is mounted in parallel on the stern S1, it is necessary to avoid mutual interference between the adjacent outboard engines 1. Therefore, both sides of the buoyant member 20 have anti-interference concavities 20L, 20R that are constricted toward the joint surfaces 26, 26 of the left and right buoyant member halves 21L, 21R (the longitudinal center direction of the outboard engine 1), as shown in FIG. 2. The left and right anti-interference concavities 20L, 20R are symmetrically shaped about the joining surfaces 26. The vertically central portions 20La, 20Ra of the avoidance concavities 20L, 20R are the most constricted part and constitute the narrowest part of the outboard engine 1.

The anti-interference concavities 20L, 20R expand both to the left side and to the right side in the upper halves 20*i*, 20*i*. The lower halves 20*j*, 20*j* also expand to both sides, and the width W of these halves is substantially the same as that of the upper halves 20*i*, 20*i*. The width W is noticeably greater than the width of the propeller 6 and the anti-cavitation plate 10.

The anti-interference concavities 20L, 20R have a transversely oriented V shape that gradually widens in the rearward direction from the front portion to the rear portion of the outboard engine 1, as shown in FIG. 1.

Thus, since the buoyant member 20 of the first embodiment has anti-interference concavities 20L, 20R in both sides, interference with other outboard engines 1 can be avoided even if an adjacent outboard engine 1 is tilted up when a plurality of outboard engines 1 is mounted in parallel on the stern. This is particularly useful during storage and maintenance of the outboard engines 1.

A second embodiment of the outboard engine is described next with reference to FIGS. 7 to 9.

The outboard engine 1 of the second embodiment differs only in the shape of the buoyant member 20, and the configuration of other components is the same. Therefore, the same reference numerals are assigned to the same components as those in the first embodiment, and a description thereof is omitted.

Figure 7:
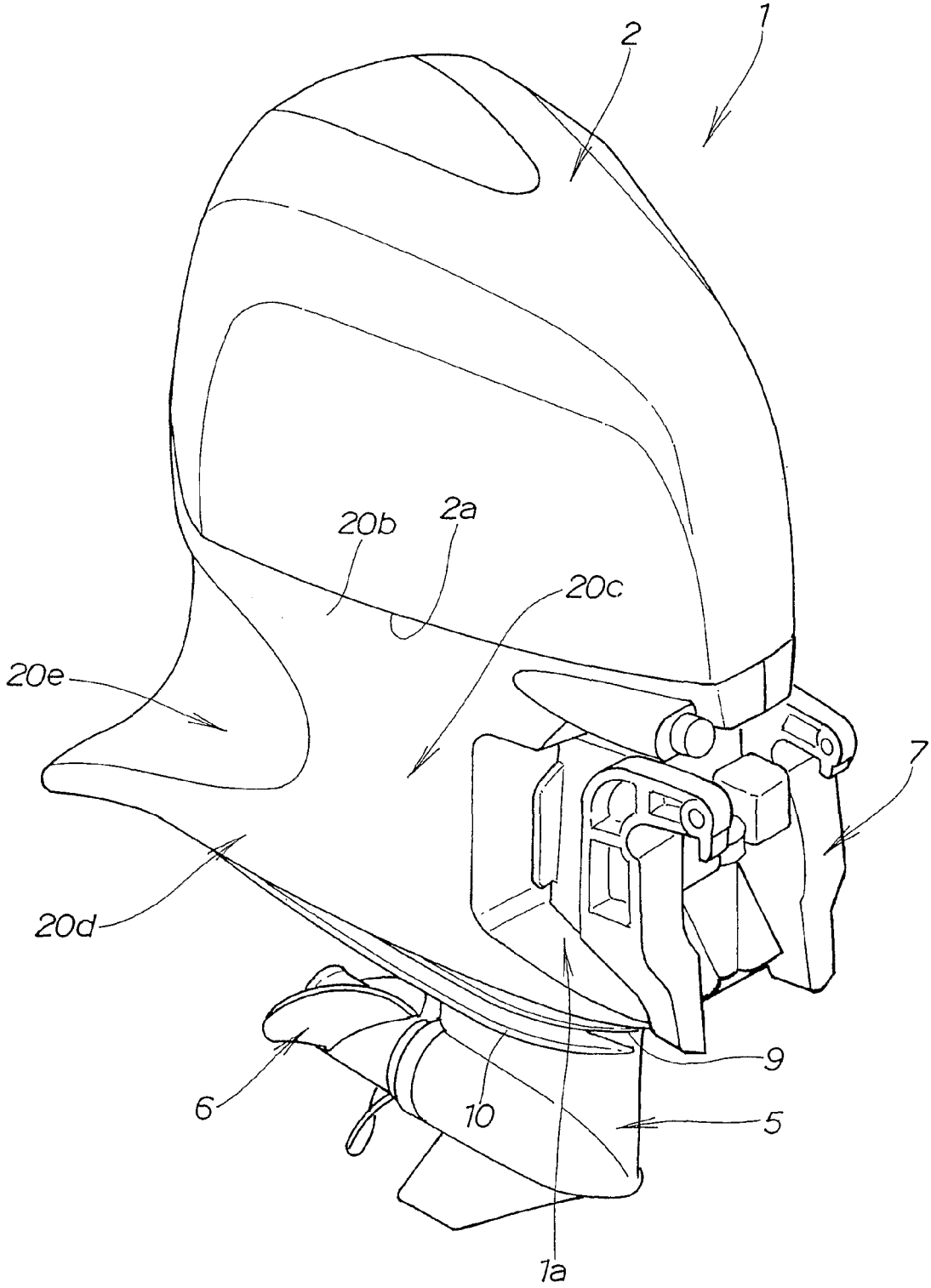
FIG. 7 is a perspective view of an outboard engine according to a second embodiment of the present invention.
Figure 8:
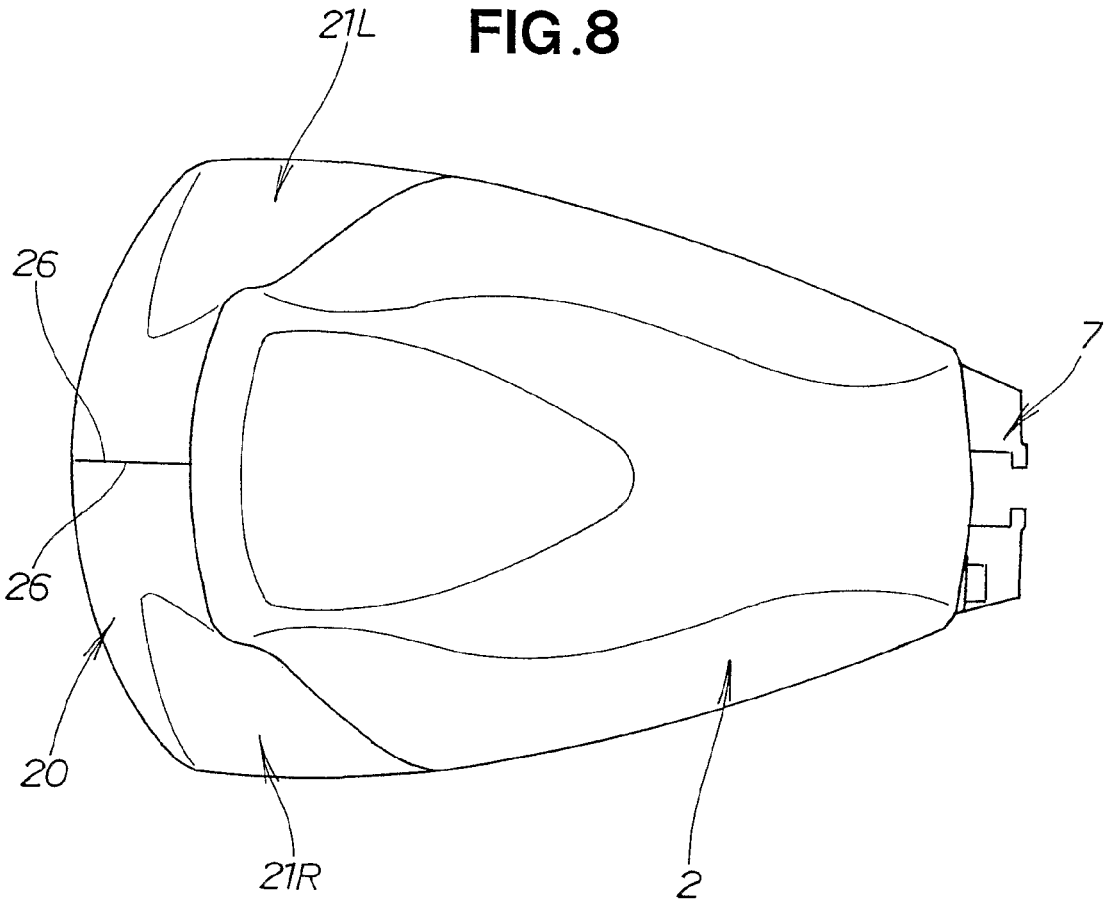
FIG. 8 is a plan view of the outboard engine shown in FIG. 7.
Figure 9:
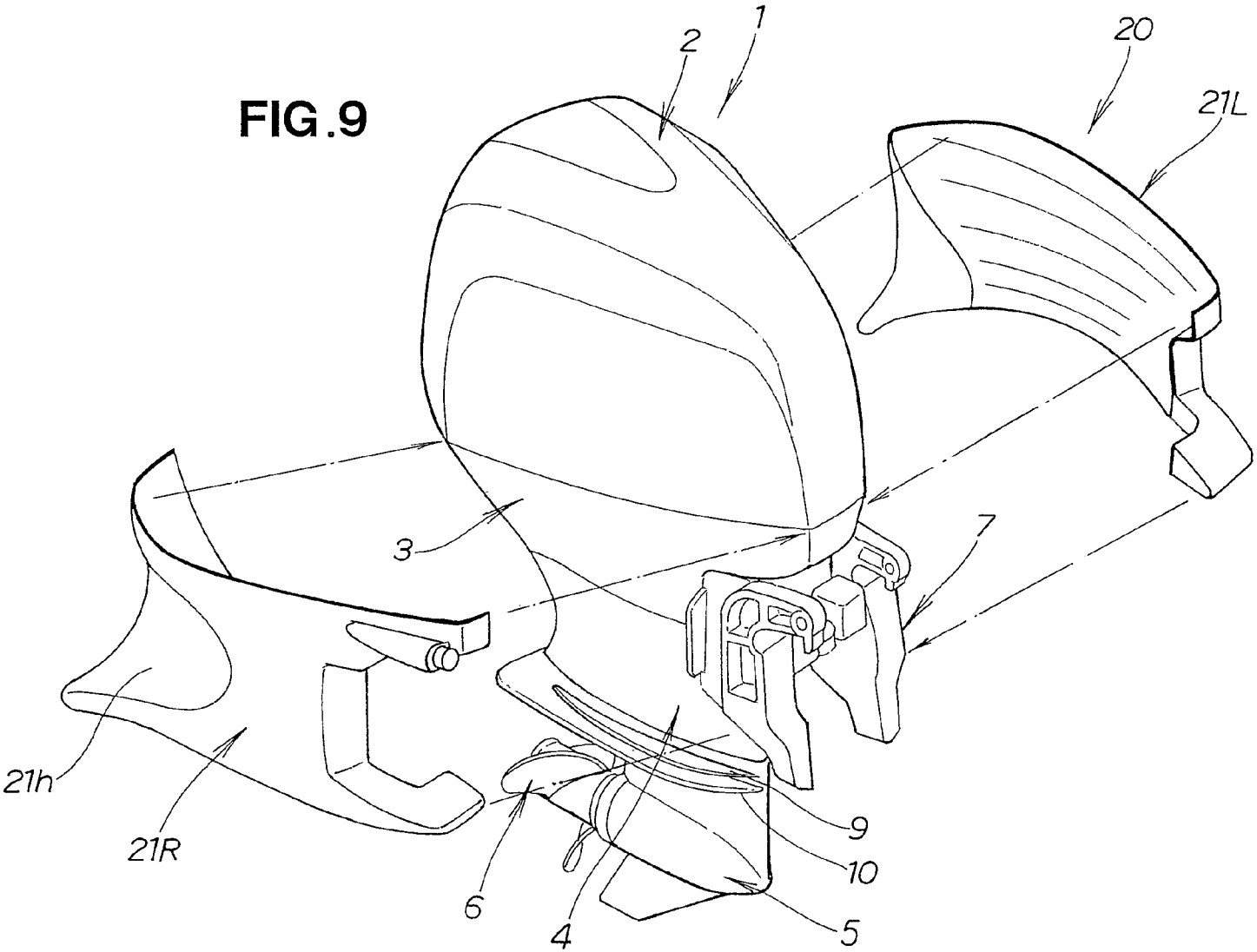
FIG. 9 is an exploded perspective view of the outboard engine shown in FIG. 7.

The two side portions of the vertically intermediate portion in the rear portion of the buoyant member 20 of the second embodiment have concavities 20*e* formed substantially in a transverse V-shape that vertically widens in the rearward direction, as shown in FIGS. 7 to 9. The concavities 20*e* are symmetrically formed as concavities 21*h* (only one is shown) in the intermediate portion of the rear portion of the left and right buoyant member halves 21L and 21R. The concavities 20*e* of the buoyant member 20 reduce water resistance when the boat accelerates from a standstill.

The concavities 20*e* in the second embodiment described above are designed so as to be shorter in the lengthwise direction of the outboard engine 1 than the anti-interference concavities 20L, 20R in the first embodiment.

An outboard motor of the third embodiment will next be described with reference to FIG. 10. The same reference numerals are assigned to the same components as those in the first embodiment, and a description thereof is omitted.

In the outboard engine 1 of the third embodiment, an anti-interference concavity 120R is provided only to the starboard side of the buoyant member 20, for example. Therefore, the buoyant member halves 21L, 21R are asymmetrical to the left and right.

Only the right buoyant member half 21R of the outboard engine 1 of the third embodiment has an anti-interference concavity 120R. Therefore, when another outboard engine 1 is disposed on the right side of this outboard engine 1, it is possible to prevent interference on the right side with the outboard engine 1 disposed on the right side.

Figure 11:
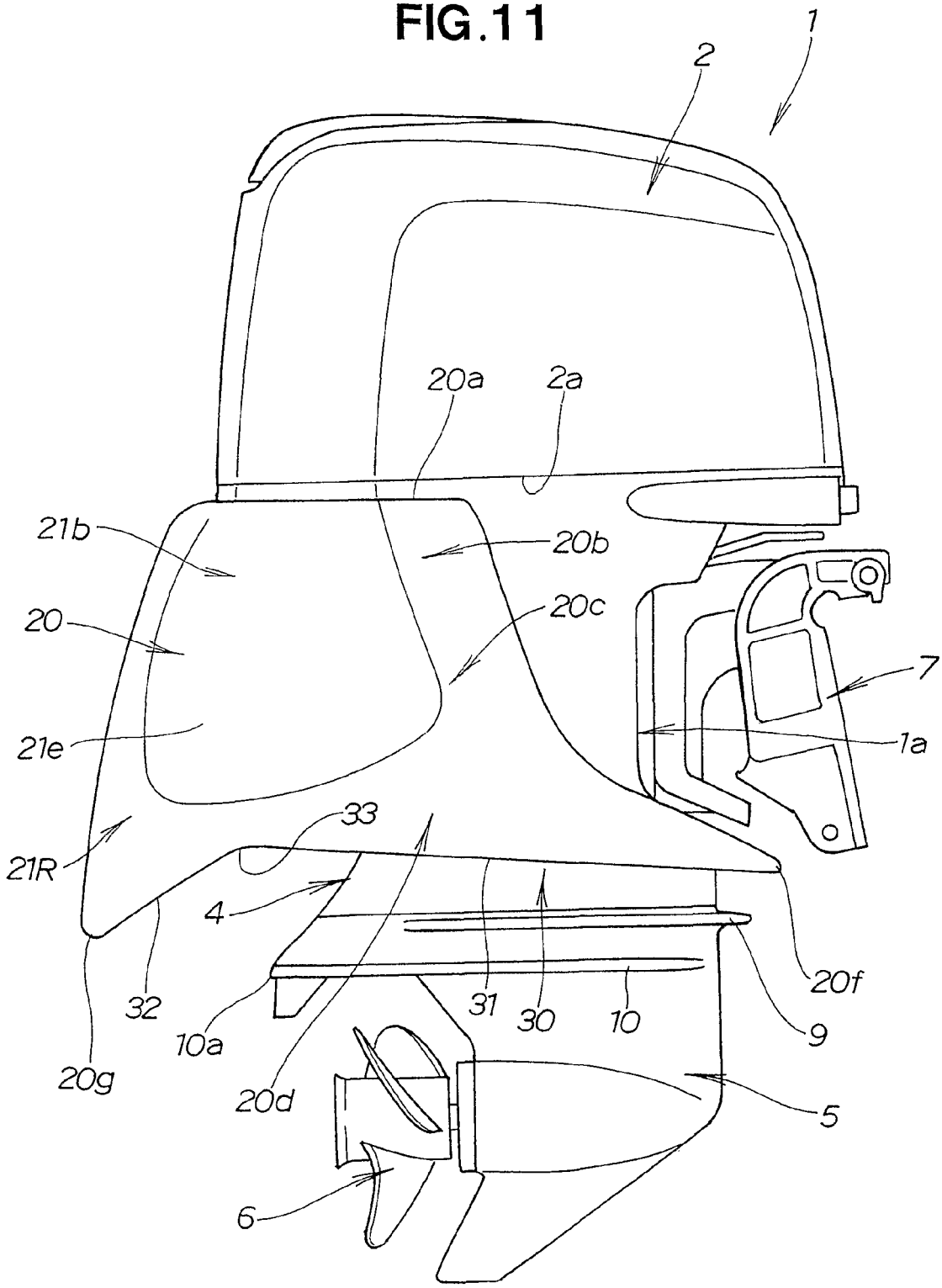
FIG. 11 is a side view of an outboard engine according to a fourth embodiment of the present invention.

FIG. 11 shows the outboard engine 1 of the third embodiment.

The shape of the concavities 21*e* formed in the side surfaces of the buoyant member 20 of the third embodiment differs from that of the embodiment shown in FIG. 1.

In FIG. 11, the concavities 21*e* extends from the longitudinally intermediate portion to the rear portion of the outboard engine 1, and from the upper end portion to the lower portion in the vertical direction. The concavities have a substantial U-shape, as viewed from the side. The shape of the concavities 21*e* has a substantially equal aspect ratio. The upper end 20*a* of the buoyant member 20 of the present embodiment is designed so as to be slightly lower than the lower edge 2*a* of the engine cover 2.

Figure 12:
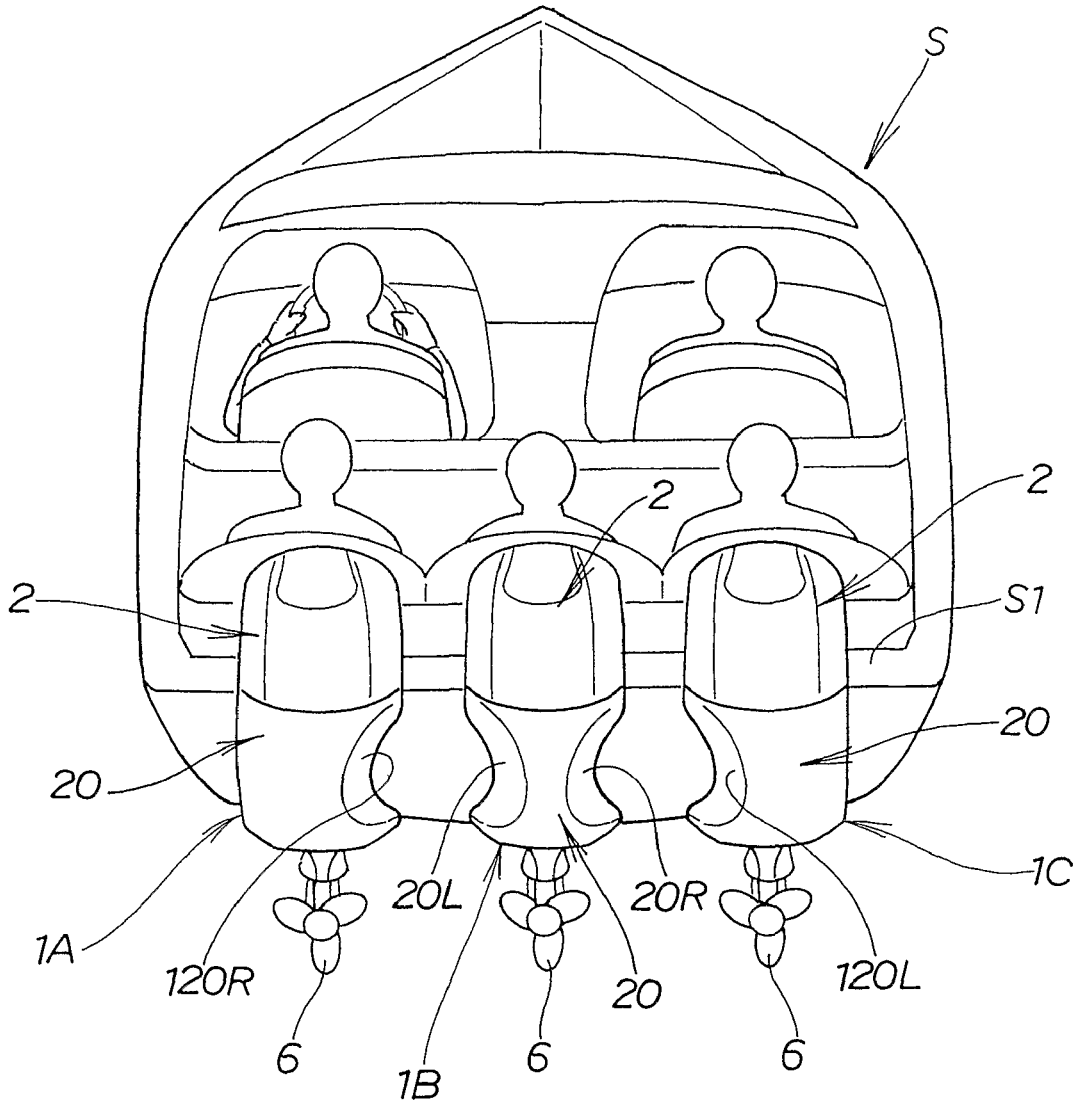
FIG. 12 is a diagram showing a state in which the outboard engine of the first embodiment and the outboard engine of the third embodiment are mounted in parallel on the stern.

FIG. 12 shows an embodiment in which a plurality of outboard engines 1, e.g., three outboard engines 1A, 1B, and 1C, is mounted on the stern S1 in parallel at an interval to the left and the right.

The buoyant member 20 of the central outboard engine 1B, which is one of the three outboard engines 1A, 1B, and 1C, has left and right anti-interference concavities 20L, 20R. Interference that occurs when the two adjacent outboards 1A, 1C are tilted up can be prevented by the anti-interference concavities 20L, 20R.

Figure 10:
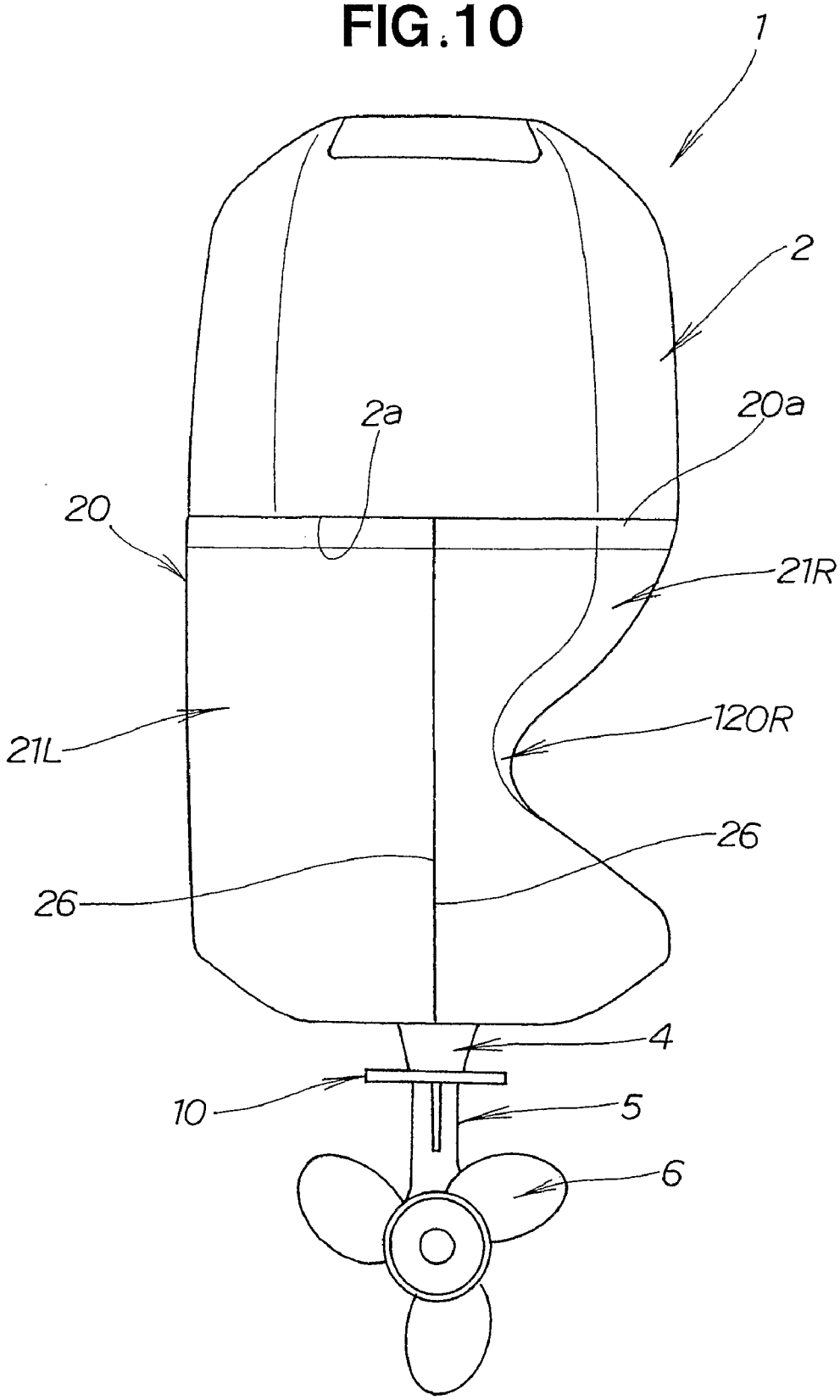
FIG. 10 is a rear view of an outboard engine according to a third embodiment of the present invention.

An anti-interference concavity 120R is formed in the starboard side of the buoyant member 20 of the right outboard engine 1A, which is one of the outboard engines 1A, 1C disposed to the left and right, in the same manner as in the third embodiment shown in FIG. 10. Interference with the buoyant member 20 is therefore prevented when the middle outboard engine 1B is tilted.

An anti-interference concavity 120L is formed in the port side of the buoyant member 20 of the outboard engine 1A disposed on the left side. In other words, the anti-interference concavity 120L is formed in the port side, which is the reverse of the third embodiment shown FIG. 10. Interference with the buoyant member 20 is therefore prevented when the middle outboard engine 1B is tilted.

In the present invention, part of a broadside of the buoyant member 20 is provided with anti-interference concavities 20L, 20R, 120R, 120L on the left and right sides, or only on one side. Therefore, in cases in which two or more outboard engines provided with a buoyant member are mounted in parallel on the stern, interference between the outboard engines can be prevented when the engines are turned for steering, and particularly tilted during storage. Therefore, a plurality of outboard engines can be freely mounted without leaving a mutual installation gap larger than necessary when the outboard engines provided with a buoyant member are mounted on the stern.

INDUSTRIAL APPLICABILITY

The outboard engine of this invention is useful for creating buoyancy and allowing the hull to smoothly and rapidly transition to high speed travel in the initial stage of propulsion, and is particularly useful when a plurality of outboard engines is mounted in parallel on the stern.

The invention claimed is:

1. A stern comprising:

a plurality of outboard motors are mounted in parallel, wherein each of said outboard motors comprises a power source, a power source room accommodating the power source, and a buoyant member disposed outside of the power source room having a concavity formed in at least one external lateral side surface of the buoyant member, a front end portion of the buoyant member is positioned so as to protrude forward from a front end of the power source, a rear end portion of the buoyant member is positioned so as to protrude rearward beyond a propeller and a rear end of an anti-cavitation plate, and interference between adjacent outboard engines is prevented during steering and tilting.

* * * * *